United States Patent [19]

Russell

[11] 4,124,498

[45] Nov. 7, 1978

[54] SEMI-CYLINDRICAL OSCILLATING SIFTER

[76] Inventor: Robert E. Russell, 2710 Landers Ave., Nashville, Tenn. 37211

[21] Appl. No.: 776,939

[22] Filed: Mar. 11, 1977

[51] Int. Cl.[2] ..... B07B 1/28

[52] U.S. Cl. ..... 209/267; 209/275; 209/370

[58] Field of Search ..... 209/245, 252, 275–277, 209/406–407, 282, 280, 370, 373, 261–265, 267, 493, 240, 284, 287; 64/31; 403/381

[56] References Cited

U.S. PATENT DOCUMENTS

| | | | |
|---|---|---|---|
| 807,423 | 12/1905 | Fern | 209/275 |
| 943,204 | 12/1909 | Treischman | 209/282 |
| 959,854 | 5/1910 | Grierson | 403/381 |
| 1,299,379 | 4/1919 | Owens | 209/276 |
| 1,379,550 | 5/1921 | Gase | 209/406 |
| 1,791,186 | 2/1931 | Black | 403/381 |
| 2,538,654 | 1/1951 | Petersen | 403/381 |
| 3,752,315 | 8/1973 | Hubach | 209/240 |

*Primary Examiner*—Robert Halper
*Assistant Examiner*—Jon E. Hokanson
*Attorney, Agent, or Firm*—Victor J. Evans & Co.

[57] ABSTRACT

A power driven oscillating sifter oscillated by a motor driven crank arm with the sifter having a pair of end plates and a central baffle all secured to the shaft. A perforated semi-cylindrical sifter panel is detachably secured to the end panels by means of inturned flanges on the end panels. The sifter panel has a plurality of longitudinally extending ribs for agitating the material to be sifted and openings are provided in the baffle and the lower end wall to permit the exit of materials which will not pass through the perforations of the sifter panel.

5 Claims, 5 Drawing Figures

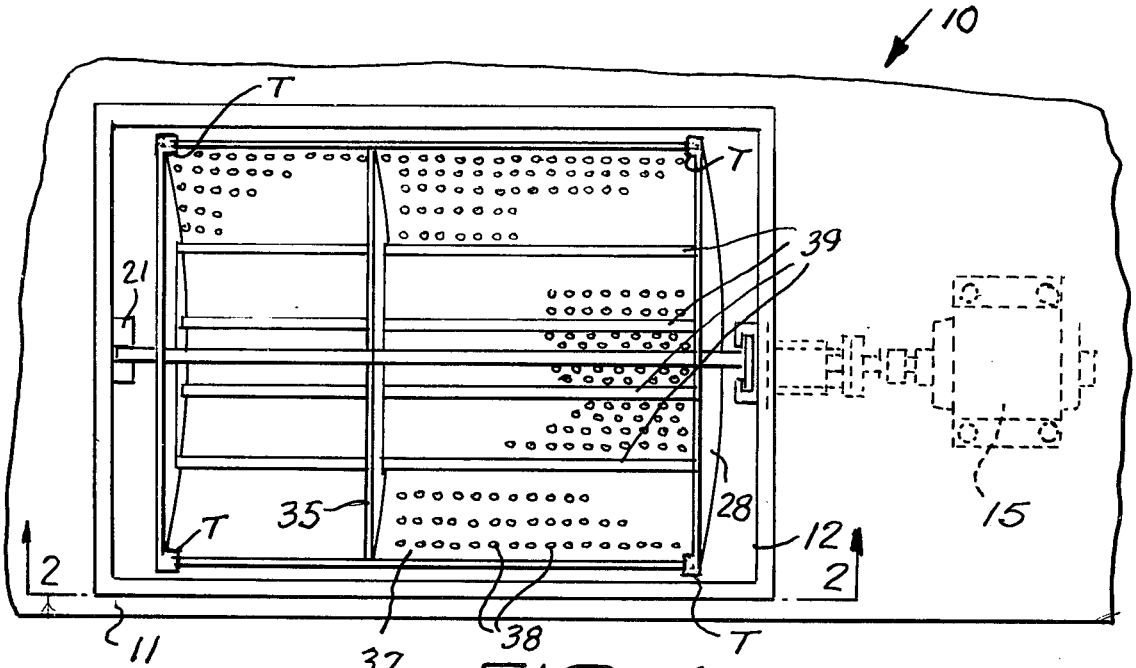
FIG. 1.
FIG. 2.
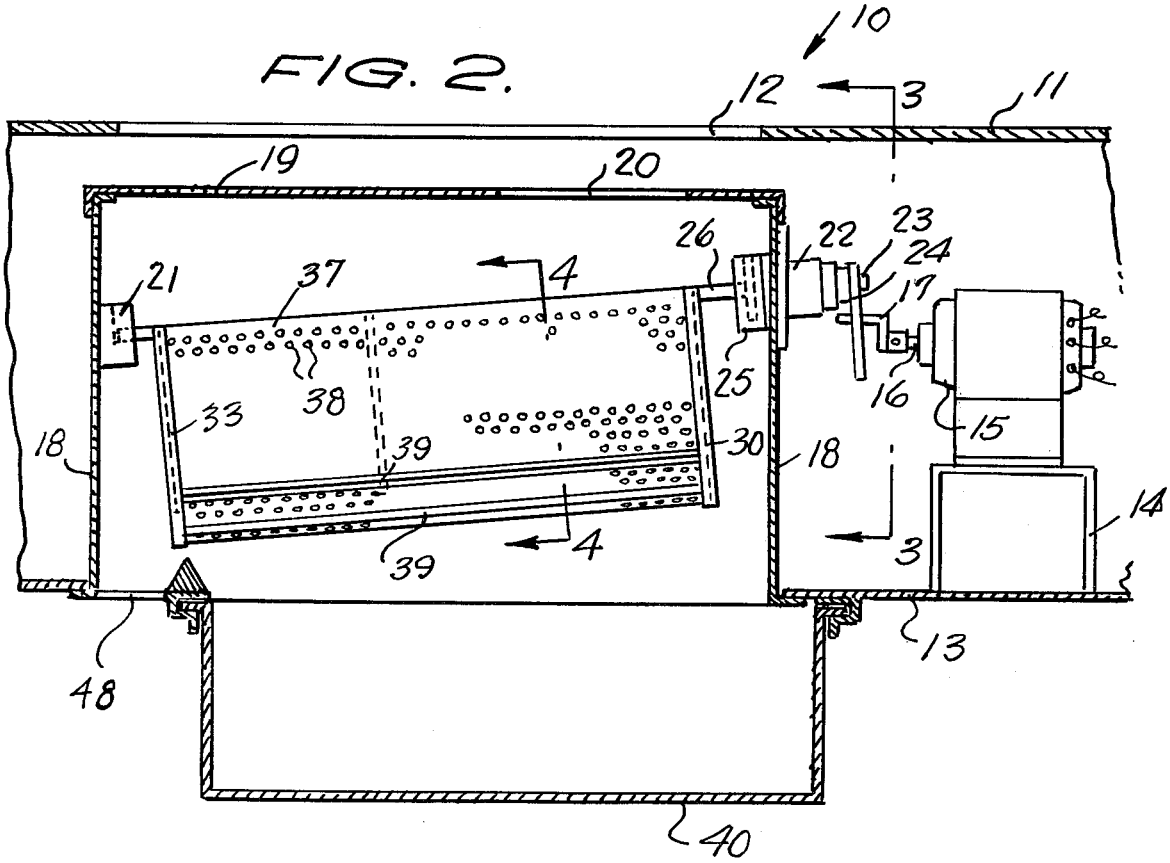

SEMI-CYLINDRICAL OSCILLATING SIFTER

BACKGROUND OF THE INVENTION

Field of the Invention

The present invention relates to a sifter for sifting materials such as flour.

SUMMARY OF THE INVENTION

The sifter of the present invention includes an elongate sloping shaft having a pair of end panels rigidly secured thereto and a baffle panel secured to the shaft intermediate the end panels. A sifter panel is detachably secured to the end panels underlying an inturned flange at each of the end panels and supported by the baffle panels. A plurality of ribs formed in the sifter panel assist in agitating the material to be sifted as the axle is oscillated back and forth by a motor driven crank arm.

The primary object of the invention is to provide a power driven sifter which can be readily disassembled for cleaning.

Other objects and advantages will become apparent in the following specification when considered in light of the attached drawings.

BRIEF DESCRIPTION OF THE DRAWINGS

FIG. 1 is a top plan view of the invention;

FIG. 2 is a vertical sectional view taken on the line 2—2 of FIG. 1 looking in the direction of the arrows;

DESCRIPTION OF THE PREFERRED EMBODIMENT

Figure 3:
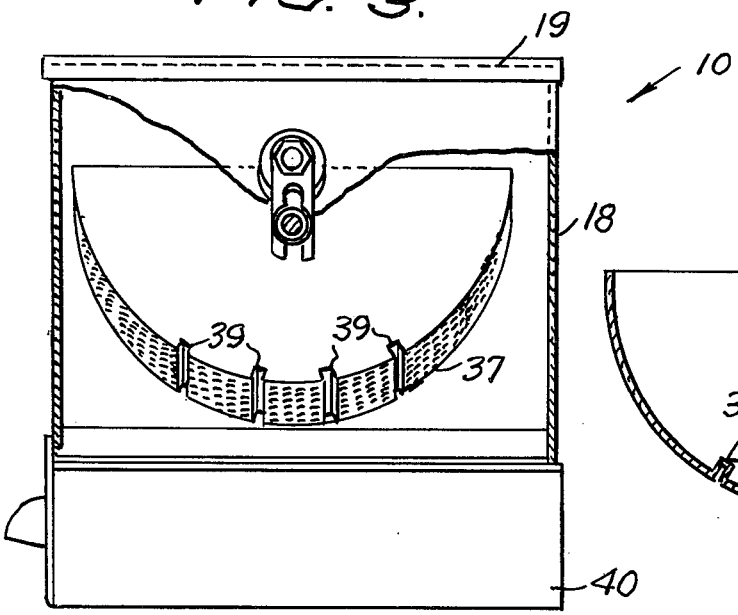
FIG. 3 is a fragmentary transverse sectional view taken along the line 3—3 of FIG. 2, looking in the direction of the arrows, partially broken away for convenience of illustration.
Figure 4:
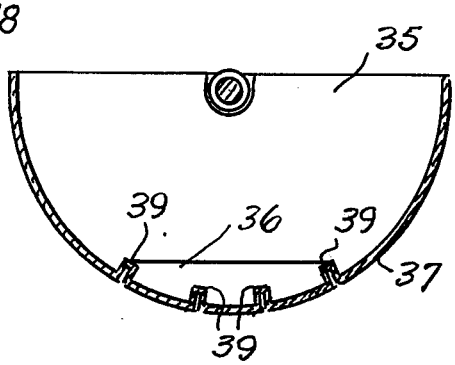
FIG. 4 is a fragmentary transverse sectional view taken along the line 4—4 of FIG. 2, looking in the direction of the arrows.
Figure 5:
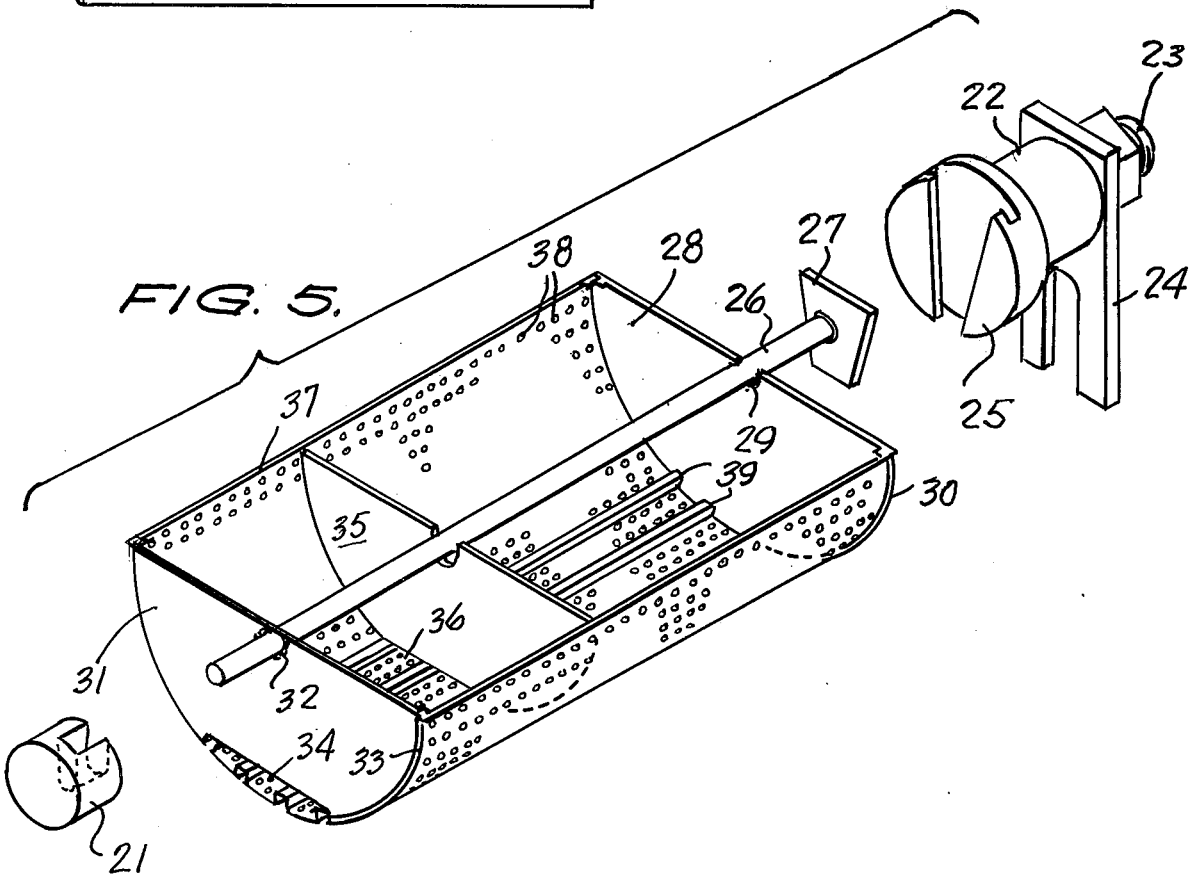
FIG. 5 is an exploded perspective view of the sifter removed from its support.

Referring now to the drawings in detail wherein like reference characters indicate like parts throughout the several figures the reference numeral 10 indicates generally a power driven sifter constructed in accordance with the invention.

The sifter 10 includes a table top 11 having a generally rectangular aperture 12 opening downwardly therethrough as can be best seen in FIGS. 1 and 2.

A shelf 13 is supported beneath the table top 11 and has a motor support 14 mounted thereon. A motor 15 is secured to the motor support 14 and has a drive shaft 16 extending from one end thereof. A crank 17 is secured on the shaft 16 for reasons to be assigned.

A housing 18 is supported on the shelf 13 and has a removable cover 19 supported thereon. The cover 19 has an opening 20 therein for giving access to the housing 18.

An open top bushing 21 is secured to the housing 18 and a bearing 22 is secured to the housing 18 oppositely to the bushing 21 and in a somewhat higher position. A shaft 23 is journalled in the bearing 22 and has a slotted yoke 24 secured thereto.

A tapered slotted bayonet bracket 25 is secured to the shaft 23 within the housing 18. A shaft 26 is supported at its lower end in the bushing 21 and slopes upwardly toward the bracket 25. A tapered block 27 is secured to the upper end of the shaft 26 and is received in the bracket 25 for easy removal.

An end panel 28 having a semi-circular shape is secured to the shaft 26 by means of welding 29 adjacent the upper end of the shaft 26. A flange 30 is formed on the outer edge of the panel 28 so that the flange lip thus formed extends toward the lower end of the shaft 26.

A semi-circular end panel 31 is secured to the shaft 26 by welding 32 adjacent the lower end of the shaft 26. A flange 33 is formed on the outer edge of the panel 31 so that its flange lip extends toward the upper end of the shaft 26.

An aperture 34 is formed in the end panel 31 for reasons to be assigned. A baffle panel 35 having an aperture 36 formed therein is positioned intermediate the end panels 28, 31 and parallel thereto.

An elongate flexible perforated sifter panel 37 is engaged under the flanges 30, 33 at opposite ends thereof and supports the baffle panel 35 with sifter panel 37 being adapted to be readily removed from the sifter 10 for cleaning. The sifter panel 37 has a plurality of perforations 38 formed throughout its extent to permit fine material to pass therethrough. A plurality of elongate spaced apart parallel ribs 39 are formed in the bottom of the sifter panel 37 to agitate the material to be sifted as the shaft 26 is oscillated.

A pan 40 is provided for receiving the sifted material passing through the sifter panel 37 and an opening 48 is provided for receiving the coarse material which passes out of the sifter 10 through the apertures 34, 36.

In the use and operation of the invention material to be sifted is poured through the aperture 20 in the cover 19 and the motor 15 is energized to oscillate the shaft 26 and the sifter 10. The material to be sifted passes outwardly through the apertures 38 and is constantly agitated by the ribs 39 so as to pass freely from the sifter 10 with materials too large to pass through the apertures 38 moving outwardly through the aperture 36 of the baffle 35 and through the aperture 34 of the end panel 31. When it is desired to clean the sifter 10 the cover 19 is first removed and the shaft 26 is lifted from its supports up through the opening 12 in the table top 11. The sifter panel 37 is removed from the yoke and block 24, 27 respectively whereupon cleaning in the normal manner is undertaken.

It should be noted that the sifter panel 37 is retained within the flanges 30, 33 by means of end tabs T overlying each corner of the panel 37.

Having thus described the preferred embodiment of the invention it should be understood that numerous structural modifications and adaptations may be resorted to without departing from the spirit of the invention.

What is claimed is:

1. A sifter for separating large particles from fine particulate matter comprising: a perforated sifter panel of substantially semi-cylindrical configuration having parallel end panels disposed at extremities of said sifter panel in which said sifter panel and said end panels are oriented to be on an incline relative to a true horizontal plane and in which one of said end panels is vertically lower than the other, wherein the lower end panel is provided with an aperture at its lower extent, said sifter further including a baffle panel disposed parallel to and inbetween said end panels, said baffle panel further having an aperture at its lower extent so that said sifter panel, end panels and baffle panel define two isolated upper and lower compartments inter-connected by said aperture on said baffle panel and said sifter is provided with means to oscillate said sifter whereby the material to be sifted is disposed within the upper compartment and the sifter is oscillated and said baffle panel serves to delay the deployment of the material to the lower compartment; said means to oscillate said sifter includes a shaft which supports said sifter at said end panels and shaft is inclined from the horizontal similar to said end panels, said shaft supported at its lower end by an open top bushing and at its upper end by a tapered block connected to said shaft which nests within a bayonet bracket, said bayonet bracket having a tapered slot complimentally formed to receive said tapered block, said bayonet bracket further connected to an inverted substantially U-shaped yoke which is slideably disposed on a motor driven crank whereby said motor driven crank provides oscillatory motion.

2. A device as claimed in claim 1 wherein said sifter panel has a plurality of ribs extending longitudinally thereof in spaced apart parallel relation.

3. A device as claimed in claim 1 wherein said sifter panel is connected to said end panels by flanges on said end panels.

4. The device of claim 1 further including a housing which overlies said sifter, said housing having an opening which overlies said upper compartment to allow introduction of material to be sifted.

5. The device of claim 4 in which a pan is disposed under said sifting panel to catch the fine particulate sifted material, and in which there is an opening between said pan and said housing to allow egress of the large particles which come through the aperature of said lower end panel.

* * * * *